United States Patent [19]

Tokumoto et al.

[11] 4,113,581

[45] Sep. 12, 1978

[54] ELECTRODEPOSITION PROCESS

[75] Inventors: Shin-Ichi Tokumoto; Eiji Tanaka, both of Yokohama; Tatsuo Kikuchi, Hoya; Kenji Ogisu, Yokohama; Toshiro Tsumori, Tokyo, all of Japan

[73] Assignee: Sony Corporation, Tokyo, Japan

[21] Appl. No.: 801,640

[22] Filed: May 31, 1977

[30] Foreign Application Priority Data

Jun. 4, 1976 [JP] Japan ..... 51-65920

[51] Int. Cl.[2] ..... C25D 3/66

[52] U.S. Cl. ..... 204/39

[58] Field of Search ..... 204/39, 64 T

[56] References Cited

U.S. PATENT DOCUMENTS 2,943,032 6/1960 Benner ..... 204/64 T 3,699,014 10/1972 Eisner ..... 204/DIG. 10

4,016,052 4/1977 Tokumoto ..... 204/39

*Primary Examiner*—John H. Mack

*Assistant Examiner*—William Leader

*Attorney, Agent, or Firm*—Hill, Gross, Simpson, Van Santen, Steadman, Chiara & Simpson

[57] ABSTRACT

An electroposition process wherein solid metallic particles are produced in a fused salt electrolytic bath and dispersed therein to electrodeposit a metal or alloy thereof on a cathode so that the surface of the deposit is maintained smooth and flat. In order to produce particles of a desired metal or alloy, an auxiliary electrolytic means may be provided within an electrolytic cell so that such particles are generated in situ within the fused bath of such cell.

10 Claims, 3 Drawing Figures

Fig. 1
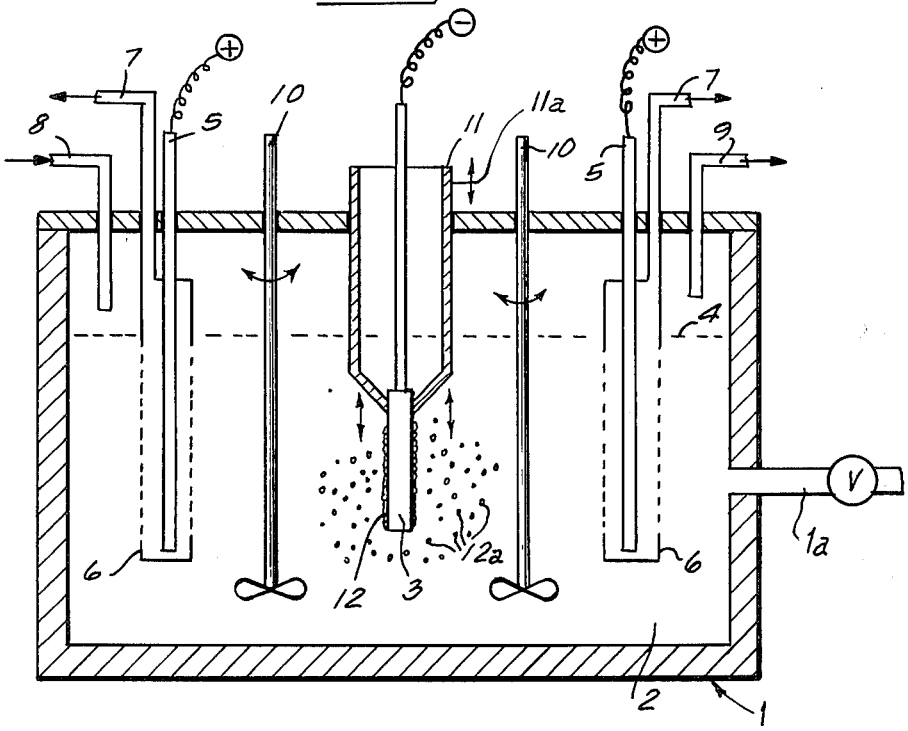
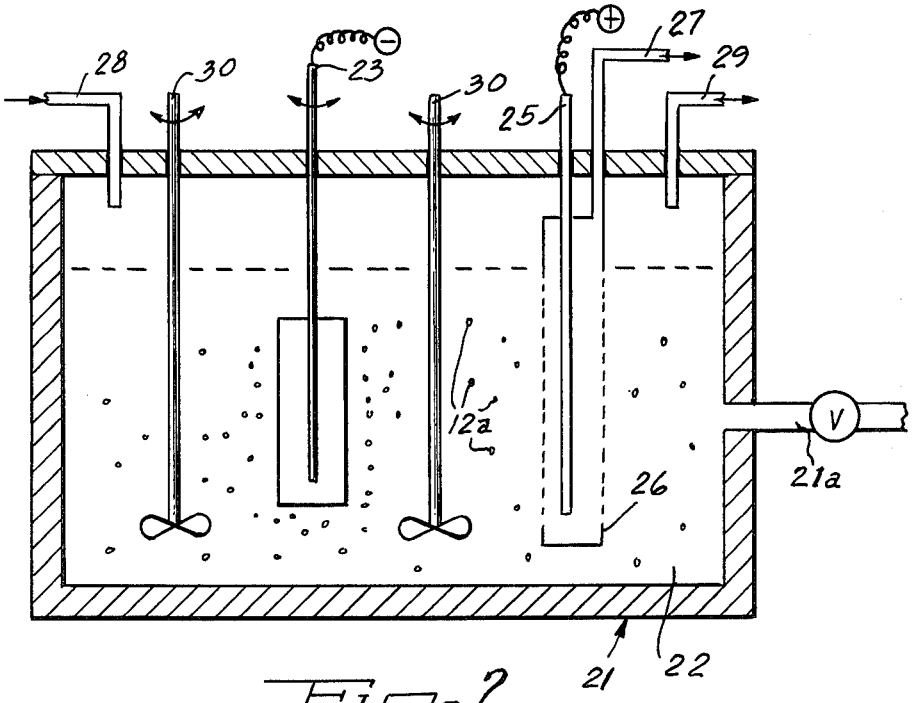
Fig. 2

ELECTRODEPOSITION PROCESS

BACKGROUND OF THE INVENTION

1. Field of the Invention

The invention relates to an electrodeposition process and somewhat more particularly to an electrolytic process involving the use of a fused salt electrolyte.

2. Prior Art

When a desired metal or alloy, such as titanium, is electrodeposited by prior art fused salt electrolytic methods, the deposited metal or alloy thereof is generally obtained only as powder, granulated crystals, dendrite or sponge. When such electrodeposited metallic material is collected, a substantial amount of electrolyte is lost during separation of the deposited material from the electrolytic bath. In addition, if the deposited metal or alloy, for example, titanium metal, is relatively active to oxygen or the like, such deposited material is readily contaminated by oxygen or other foreign substances due to the above mentioned surface configurations and various difficulties are encountered in the subsequent processing of such materials.

We have proposed various electrodeposition processes in which a novel fused salt electrolytic bath is used so that even a metal whose compact electrodeposition has been considered difficult, is grown by electrodeposition, with the surface of the deposit being maintained plate-like or flat thereby obtaining a compact electrodeposition material having a desired thickness which can be readily processed, such as by rolling or forming operations. (J. of Metals, Vol. 27, No. 11, November 1975, pp. 18–23) In addition, we have proposed electrodeposition processes, such as disclosed in Japanese Pat. Nos. 131960/1974 which corresponds to U.S. Pat. No. 4,016,052 and 107500/1974 which corresponds to U.S. Pat. No. 4,049,507, wherein solid particles are dispersed in a fused salt electrolytic bath and a relative flow rate is generated between an electrolyte containing such solid particle and the cathode or electrodeposition surface so as to achieve an improved electrodeposition.

However, even in the novel processes disclosed, for example, in our earlier referenced Japanese Pat. application No. 131960/1974, when solid particles to be dispersed within a fused electrolytic bath are fed into such bath from outside thereof, contaminations may occur since a component, such as an oxide, which is different from the components originally in the electrolyte, may be introduced into the electrolytic bath. Such foreign component causes a deterioration in the quality of the electrodeposited material to occur, and produces difficulties in maintaining the electrolyte over a prolonged period of time, as well as other difficulties.

SUMMARY OF THE INVENTION

It is a main object of the invention to provide an electrodeposition process wherein solid particles are produced in a fused salt electrolytic bath so that contamination of such particles, as by oxidation or the like, is avoided.

It is another object of the invention to provide an electrodeposition process wherein solid metallic particles are dispersed in a fused salt electrolytic bath and a desired metal or alloy is electrodeposited from such bath on an electrodeposition surface, with the surface of the deposit being maintained relatively smooth and flat.

In accordance with one embodiment of the invention, an electrodeposition process comprises preparing a fused salt electrolytic bath, providing a main electrode for electrodeposition within said bath, providing an auxiliary electrode spaced from the main electrode within said bath, depositing solid metallic particles on the auxiliary electrode from such bath and dispersing such particles within the bath, and then electrodepositing a metal or alloy on the main electrode from the bath containing dispersed solid particles therein.

Other objects, features and advantages of this invention will become more apparent from the following description taken in conjunction with the accompanying drawings.

BRIEF DESCRIPTION OF THE DRAWINGS

FIG. 1 is a somewhat schematic cross-sectional view showing an embodiment of an auxiliary electrolytic cell useful in producing solid particles in the practice of a process in accordance with the principles of the invention;

FIG. 2 is a somewhat schematic cross-sectional view showing an embodiment of a main electrolytic cell useful in the practice of a process in accordance with the principles of the invention.

DESCRIPTION OF THE PREFERRED EMBODIMENTS

Figure 3:
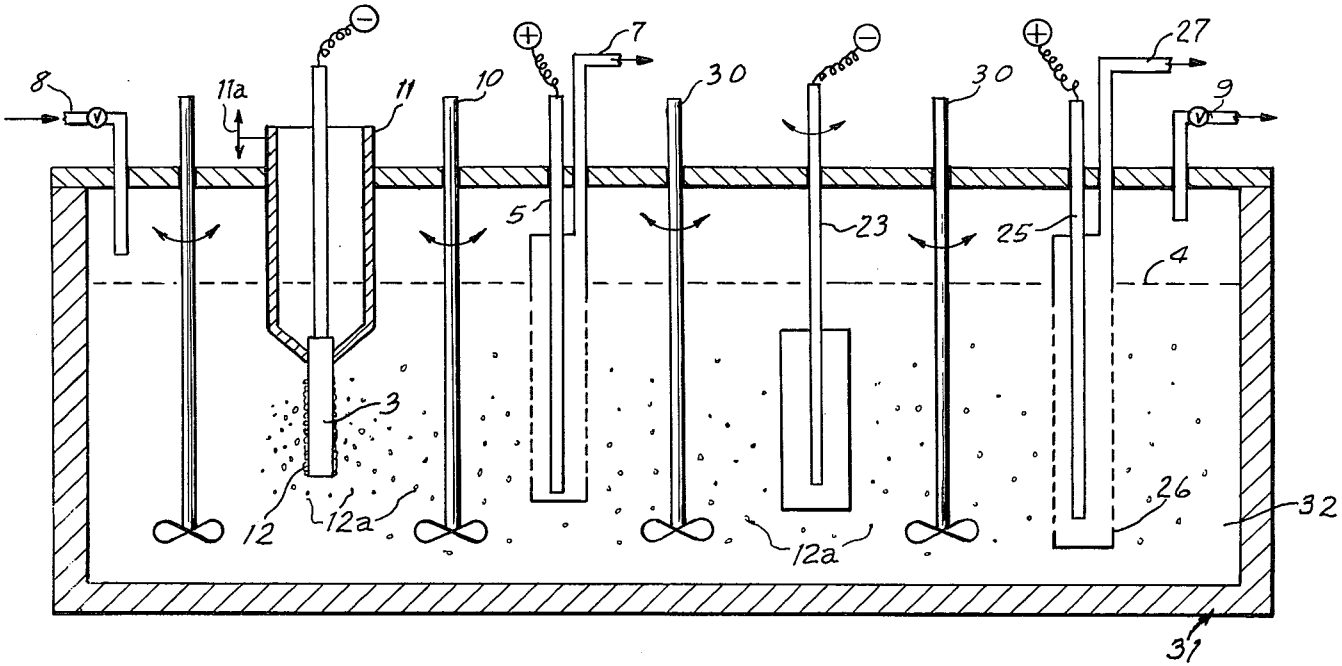
FIG. 3 is a somewhat similar view as FIGS. 1 and 2 showing an embodiment of an electrolytic cell useful in the practice of the invention.

In accordance with the principles of the invention, the electrodeposition process of the invention comprises, instead of adding solid particles to a fused electrolytic bath from the outside, as in the prior art, producing solid particles of a desired metal or alloy in a fused salt electrolytic bath and dispersing such particles within such bath without exposing the particles to an external or contaminating environment.

In accordance with the principles of the invention, a main electrolytic means is combined with an auxiliary electrolytic means within an electrolytic cell whereby solid metallic particles are produced in situ within the cell and the electrodeposition of the desired metal then occurs from the electrolytic bath containing dispersed solid particles therein. Accordingly, when solid particles are so-produced and dispersed in an electrolytic bath in accordance with the principles of the invention, foreign substances or contaminants, such as oxides and the like, cannot be introduced into the electrolyte. This results in high quality electrodeposited material and provides an electrolytic bath which is easily maintained in good condition over a prolonged period of time.

In accordance with the principles of the invention, the solid metallic particles dispersed within a fused salt electrolytic bath are not particularly limited to a given size range. Thus, solid particles produced in accordance with the principles of the invention may be dispersed in a fused salt electrolytic bath and a relative flow rate may be generated between the electrolyte containing such particles dispersed therein and an electrodeposition (i.e., cathode) surface so that a desired metal or alloy can be grown on such electrodeposition surface via electrolysis, with the surface of the deposit being maintained relatively smooth, homogeneous and flat. The advantages realized by the practice of the invention are considered to be caused or augmented by the following particle-induced phenomena: an increase in the rate of mass transfer of desired component ions, viscosity adjustment of the electrolyte region adjacent to the electrodeposition or cathode surface, a mechanical polishing action and other beneficial phenomena.

As may be apparent from the above mentioned particle-induced phenomena, the size of each solid particle is not necessarily limited to a given size range. However, when each particle is relatively large in size and is dispersed within a fused salt electrolytic bath, the electrodeposited metal or alloy is subjected to clear collision flaws and various difficulties and disadvantages may be encountered when such an electrolytic bath containing relatively large sized particles therein is stirred or vigorously agitated, such as maintaining such particles in adequate dispersion and the like. Accordingly, each solid particle is, preferably, maintained on the average of about 1 mm or less in diameter.

Referring now to the drawings, an auxiliary electrolytic cell 1 is illustrated at FIG. 1 which may be used in accordance with the principles of the invention to produce solid metallic particles therein. The cell 1 contains an electrolytic bath or electrolyte 2 therein generally comprised of fused chloride salts of alkali and alkaline metals, along with, for example, titanium chloride salts. An auxiliary cathode or electrodeposition surface 3 is positioned within the cell 1, for example, in the center thereof, so as to be immersed within the bath 2 beneath the bath surface 4 and is operationally coupled to a controlled electrical energy source. A pair of auxiliary anodes 5 are likewise positioned within the cell 1 on either side of the cathode 3 and operationally coupled to a controlled electrical energy source. A diaphragm 6 is provided about each auxilary anode as shown, along with a gas outlet 7 for removal of any gases generated during the electrodeposition process, i.e., $Cl_2$. The electrolytic bath 2 is maintained under a protective inert gas, such as argon or the like. An inert gas supply port 8 is provided in communication with the interior of cell 1 and a supply (not shown) of a select inert gas. A gas exhaust port 9 is similarly provided in communication with the interior of the cell 1 for removal of the inert gas as desired. The cell 1 is also provided with suitable stirring or agitating means 10, such as propellers, for agitating the electrolyte within the cell as desired. An apparatus of the type above described is suitable for producing solid metallic particles under controlled conditions, such as exemplified in the exemplary embodiments given below.

During the operation of the above described auxiliary electrolytic cell, a metal or alloy deposit 12 is grown on the auxiliary electrodeposition surface 3 and solid particles **12*a* of such metal or alloy are removed from such deposition surface, for example, by a scraping action of an axially movable scraping means 11, which is connected to a suitable drive means schematically indicated by the double-headed arrow 11*a*. The so-removed solid particles 12*a* are maintained in dispersion within the electrolytic bath 2 via the stirring means 10. The cell 1 is, of course, provided with a heating means (not shown) to controllably maintain the electrolytic bath 2 at a select electrolytic temperature. In addition, the cell 1 is provided with a controlled fluid passage 1*a*** for selective removing electrolyte with dispersed particles therein in an air-excluding manner.

A main electrolytic cell 21 is illustrated at FIG. 2 wherein the main electrodeposition (smooth electrodeposition) of a desired metal or alloy takes place in accordance with the principles of the invention. Such an electrolytic cell is well known and can be formed in various configurations, however, an exemplary configuration is shown in order to better illustrate the principles of the invention. Thus, an electrolytic cell 21 is provided with a select fused salt electrolytic bath or electrolyte 22, which, generally, may be composed of fused chloride alkali and alkaline earth metal salts containing therein chloride salts of a desired metal or alloy, such as Al, Be, Mn, Ti, V, Zn, Zr, etc., or Ti-Al, Ti-Fe, Ti-Mn, etc., along with the solid metallic particles **12*a* earlier described. A rotating electrodeposition surface or cathode 23 is positioned within the bath 22 so that the desired electrodeposition occurs on such surface. A main anode 25 is spaced from the cathode 23 within the bath and is provided with a diaphragm 26 which surrounds the anode 25. A gas outlet 27 is provided in communication with the anode 26 to vent any generated gas, such as chlorine or the like. A controlled gas supply port 28 and an exhaust port 29 for an inert gas, such as argon, may also be provided to maintain a protective atmosphere within the cell 21. A controlled fluid passage 21*a* is provided to allow addition of an electrolyte, as required. A suitable stirring means, such as propeller 30, is likewise provided within the cell 21 to maintain the electrolyte therein in a suitably agitated condition. With this type of cell construction, the electrolytic bath 22 having solid metallic particles 12*a* therein (produced by the auxiliary electrolysis process described earlier in conjunction with FIG. 1**) is operational to produce a smooth and substantially homogeneous electrodeposition of a desired metal or metal alloy.

In the exemplary embodiments shown at FIGS. 1 and 2, the auxiliary electrolytic cell 1 and main electrolytic cell 21 are shown as being separate, however, an integrated electrolytic cell such as shown at FIG. 3, may also be utilized wherein an auxiliary electrode and a main electrode are positioned in spaced-apart relation together within a single cell. It will be understood, of course, that electrolytic cells of configurations other than above described may also be used in the practice of the invention.

With the foregoing general discussion in mind, there is presented detailed examples, using titanium as a desired metal, which will illustrate to those skilled in the art the manner in which the invention is carried out. However, the examples are not to be construed as limiting the scope of the invention in any way.

EXAMPLE 1

A. Exemplary Process of Producing Solid Metal Particles

In an apparatus of the type described in conjunction with FIG. 1, the following parameters were established:

| Electrolytic Condition | | | |
|---|---|---|---|
| Composition of electrolyte (in mole fractions): | | | |
| LiCl | 1,000 | $TiCl_2$ | 0.067 |
| KCl | 0.681 | $TiCl_3$ | 0.007 |

($TiCl_2$ was obtained by reacting titanium metal with titanium trichloride in accordance with the following equation: $Ti + 2TiCl_3 \rightarrow 3TiCl_2$)

| | |
|---|---|
| Current type and density: | DC 20Adm$^{-2}$ |
| Stirring of electrolyte: | None |
| Auxilliary cathode: | stationary electrode composed of stainless steel having a plate shape with the approximate dimensions of 30 × 50 × 3 mm. |
| Auxiliary anode: | stationary plate-like carbon electrode. |

-continued

| Electrolytic Condition | |
|---|---|
| Solid particles placed in electrolyte before operation commenced: | none |
| Electrolytic temperature: | 450° C. |

Upon commencement of electrodeposition, consumed titanium salts were periodically supplied as required:

B. Electrolytic Bath Condition After Electrolysis

| | |
|---|---|
| Composition of electrolyte: | substantially the same as prior to electrolysis. |
| Particles in electrolyte: | |

During and after completion of the electrolysis, electrodeposited material was removed from the surface of the auxiliary cathode, as by sliding movement of a scraping means and the electrolyte was stirred, as by a propeller, so as to disperse therein solid particles. Thereafter, a sample of such electrolyte was taken and metal titanium particles having an average grain size of about 150 μm were observed. The amount of such titanium particles was about 15 vol. %, based on the total volume of the bath.

C. Process of Smooth Electrodeposition (Main Electrodeposition) of Metal Titanium Electrodeposition was conducted in an apparatus substantially similar to that described in conjunction with FIG. 2 and the following parameters were established therein:

| Electrolytic Condition | |
|---|---|
| Composition of electrolyte: | substantially identical to the electrolyte bath described in sub-paragraph A above, but including the particles of titanium metal produced in sub-paragraph B above dispersed therein. |
| Current type and density: | DC 20Adm$^{-2}$ |
| Rotating rate of stirring propellers: | 2000 rpm |
| Main cathode: | cylindrically-shaped stainless steel electrode having a diameter of about 20 mm. |
| Rotating rate of main cathode: | 2000 rpm |
| Main anode: | essentially identical to the auxiliary anode described in sub-paragraph A above. |
| Electrolytic temperature: | 450° C. |

Electrodeposited Material

The electrodeposited material, i.e., the deposit, after washing, as with hydrochloric acid, had a glossy smooth surface with qualities corresponding to Class 1 of JIS (Japanese Industrial Standards).

D. Process of Smooth Electrodeposition of Metal Titanium

| Electrolytic Condition | |
|---|---|
| Composition of electrolyte: | substantially identical to the electrolyte described in B above. |
| Current type and density: | interrupted DC 30A dm$^{-2}$, energized for 0.6 sec. and cut off for 0.6 sec. |
| Rotating rate of stirring propellers: | 2000 rpm. |
| Main cathode: | same as in B above. |
| Anode: | same as in B above. |

-continued

| Electrolytic Condition | |
|---|---|
| Electrolytic temperature: | same as in B above. |

Electrodeposited Material

The electrodeposited material, after washing, had a glossy smooth surface with substantially the same qualities as obtained in sub-paragraph B above.

EXAMPLE II

A. Process of Producing Metal Particles

In an apparatus of the type described in conjunction with FIG. 1, the following parameters were established:

| Electrolytic Condition | | | |
|---|---|---|---|
| Composition of electrolyte (in mole fractions): | | | |
| $BaCl_2$ | 0.374 | KCl | 0.305 |
| $MgCl_2$ | 0.708 | $TiCl_2$ | 0.243 |
| $CaCl_2$ | 0.319 | $TiCl_3$ | 0.020 |
| NaCl | 1.000 | | |

($TiCl_2$ was obtained by the reaction of titanium metal and titanium trichloride as earlier described.)

| | |
|---|---|
| Current type and density: | interrupted DC 30A dm$^{-2}$ energized for 0.6 sec. and cut off for 0.6 sec. |
| Stirring of electrolyte: | none. |
| Auxiliary cathode: | plate-like stationary stainless steel electrode similar to that described in Example I. |
| Auxiliary anode: | a plate-like carbon electrode with the approximate dimensions of 30 × 50 × 5 mm. |
| Metallic particles placed in electrolyte before operation commenced: | none. |
| Electrolytic temperature: | 460° C. |

During operation, consumed titanium salts were periodically supplied as required.

B. Bath Condition After Electrolysis

| | |
|---|---|
| Composition of electrolyte: | substantially the same as that prior to electrolysis. |
| Particles in electrolyte: | |

After the completion of electrolysis, the electrodeposited material was examined and metal titanium particles having an average grain size of about 200 μm were observed. The amount of such particles was about 15 vol. %.

C. Smooth Electrodeposition of Titanium Metal

| Electrolytic Condition | |
|---|---|
| Composition of electrolyte: | substantially identical to the electrolyte described in II-A above, but including titanium metal particles produced in II-B above. |
| Current type and density: | interrupted DC 50A dm$^{-2}$, energized for 0.2 sec. and cut off for 0.4 sec. |
| Rotation rate of stirring propellers: | 2000 rpm. |
| Main cathode: | cylindrically shaped stainless steel electrode having a diameter of about 20 mm. |
| Rotation rate of main cathode: | 2000 rpm. |
| Main anode: | identical to that used for producing the metal particles in II-B above. |

-continued

| Electrolytic Condition | |
|---|---|
| Electrolysis temperature: | 460° C. |

Electrodeposited Material

The electrodeposited material, after washing with a suitable acid, i.e., HCl, had the same glossy smooth and substantially homogeneous flat surface as observed in Example 1-C and D above. Analysis of the electrodeposited titanium by an X-ray microanalyzer indicated that the quality thereof was equivalent to Class 1 of JIS.

As will be apparent from the foregoing Examples, the electrodeposition process of the invention, wherein solid metallic particles of a desired metal or alloy are produced within an electrolytic bath by electrolytic means and dispersed therein during the smooth electrodeposition of the desired metal or metal alloy, yield high quality deposits via electrolysis whereby the deposit is relatively homogeneous, with smooth flat surfaces, suitable for use without remelting or the like.

In the above described exemplary embodiments, a pure titanium metal was used to produce the solid metallic particles and to produce a desired flat deposit. However, it will be understood that other metal and alloy particles may be similarly produced and dispersed in electrolytic bath so as to deposit, via the smooth electrodeposition process described, a deposit of such other metal or alloy, if desired. Thus, the invention may be practiced with a metal selected at least from the group consisting of Al, Be, Mn, Ti, V, Zr, Zn and/or alloys thereof, such as Ti-Fe, Ti-Al, Ti-Mn, etc.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. An electrodeposition process comprising the steps of:

(a) preparing a fused salt electrolytic bath containing a salt of a desired metal or salts of the constituent metals of a desired alloy;

(b) providing a main cathode in said bath for electrodeposition of a metal or alloy thereon from said bath;

(c) providing an auxiliary cathode in spaced relationship from said main electrode within said bath;

(d) growing a deposit of the desired metal or alloy on said auxiliary cathode, mechanically removing the deposited metal or alloy from said auxiliary cathode to produce solid particles, and dispersing such solid particles in said bath; and (e) electrodepositing the desired metal or alloy on said main cathode from said bath containing dispersed solid particles therein.

2. An electrodeposition process as defined in claim 1 wherein said auxiliary cathode is provided with a means for removing material deposited thereon.

3. An electrodeposition process as defined in claim 1 wherein said fused salt electrolytic bath contains at least salts of Li, K and Ti.

4. An electrodeposition process as defined in claim 1 wherein said fused salt electrolytic bath contains at least salts of Ba, Mg, K, Ca, Na and Ti.

5. An electrodeposition process as defined in claim 1 wherein a main electrolytic cell and an auxiliary electrolytic cell are respectively employed to conduct steps (e) and (d).

6. An electrodeposition process as defined in claim 5 wherein said main electrolytic cell is provided with said main cathode and said auxiliary electrolytic cell is provided with said auxiliary cathode.

7. An electrodeposition process as defined in claim 1 wherein said main cathode and said auxiliary cathode are provided together within a single electrolytic cell.

8. An electrodeposition process as defined in claim 1 wherein an electrodeposited metal or metal alloy having a smooth surface is obtained on said main electrode via step (e).

9. An electrodeposition process for depositing titanium or a titanium alloy comprising the steps of:

(a) providing a fused chloride alkali and alkaline earth metal salt electrolytic bath containing a chloride titanium salt, said bath containing therein operational electrodes comprising an auxiliary cathode, a main cathode and at least one anode for electrodeposition of titanium or titanium alloy thereon;

(b) producing solid particles of titanium or titanium alloy in situ by growing a deposit of titanium or titanium alloy on said auxiliary cathode, mechanically removing the so-grown deposit to produce solid particles of titanium or titanium alloy within said bath and dispersing such particles within said fused bath; and (c) electrodepositing titanium or a titanium alloy on said main cathode from said bath.

10. An electrodeposition comprising the steps of:

(a) providing a fused chloride alkali and alkaline earth metal salt electrolytic bath containing a chloride salt of a metal selected from the group consisting of Al, Be, Mn, Ti, V, Zr, Zn and alloys thereof, said bath containing therein operational electrodes comprising an auxiliary cathode, a main cathode and at least one anode for electrodeposition of said metal or alloy;

(b) producing solid particles of said metal or alloy in situ by growing a deposit of said metal or alloy on said auxiliary cathode, mechanically removing the so-grown deposit to produce solid particles of said metal or alloy within said bath and dispersing such particles within said fused bath; and (c) electrodepositing said metal or alloy on said main cathode from said bath.

* * * * *